US007928045B2

(12) United States Patent
Dong et al.

(10) Patent No.: US 7,928,045 B2
(45) Date of Patent: Apr. 19, 2011

(54) STABILIZING COMPOSITIONS FOR LUBRICANTS

(75) Inventors: Jun Dong, Waterbury, CT (US); Gerard Mulqueen, Watertown, CT (US); Michael J. Goode, West Lafayette, IN (US); Alan Holt, West Didsbury (GB); William D. Phillips, Poynton (GB)

(73) Assignee: Chemtura Corporation, Middlebury, CT (US)

( * ) Notice: Subject to any disclaimer, the term of this patent is extended or adjusted under 35 U.S.C. 154(b) by 160 days.

(21) Appl. No.: 11/709,646

(22) Filed: Feb. 21, 2007

(65) Prior Publication Data

US 2007/0203035 A1 Aug. 30, 2007

Related U.S. Application Data

(60) Provisional application No. 60/776,934, filed on Feb. 28, 2006.

(51) Int. Cl.
*C10M 135/28* (2006.01)
*C10M 133/12* (2006.01)

(52) U.S. Cl. ..... 508/569; 508/567; 508/570; 508/572; 508/563

(58) Field of Classification Search ..... 508/485, 508/567, 569, 570, 572; 564/307, 308
See application file for complete search history.

(56) References Cited

U.S. PATENT DOCUMENTS

| | | | | |
|---|---|---|---|---|
| 2,451,642 | A | 10/1948 | Watson | 252/50 |
| 2,647,824 | A | 8/1953 | Jones et al. | |
| 2,718,501 | A | 9/1955 | Harle | 252/47 |
| 3,145,176 | A * | 8/1964 | Knapp et al. | 508/434 |
| 4,115,590 | A * | 9/1978 | Lerner | 514/712 |
| 4,824,601 | A | 4/1989 | Franklin | |
| 4,846,985 | A | 7/1989 | Rizvi et al. | |
| 5,091,099 | A | 2/1992 | Evans et al. | 508/478 |
| 5,229,442 | A * | 7/1993 | Broussard et al. | 524/87 |
| 5,232,614 | A | 8/1993 | Colclough et al. | 508/375 |
| 5,451,646 | A * | 9/1995 | Castner | 526/137 |
| 5,498,809 | A | 3/1996 | Emert et al. | 585/13 |
| 5,523,007 | A * | 6/1996 | Kristen et al. | 508/297 |
| 5,807,813 | A * | 9/1998 | Yamada | 508/363 |
| 5,840,672 | A * | 11/1998 | Gatto | 510/376 |
| 5,942,471 | A | 8/1999 | Kapuscinski et al. | |
| 6,096,695 | A * | 8/2000 | Lam et al. | 508/570 |
| 6,235,686 | B1 * | 5/2001 | Karol et al. | 508/261 |
| 2003/0134756 | A1 * | 7/2003 | Carrick et al. | 508/398 |
| 2005/0170978 | A1 * | 8/2005 | Migdal et al. | 508/497 |
| 2006/0040833 | A1 * | 2/2006 | Al-Akhdar et al. | 508/459 |
| 2006/0116301 | A1 * | 6/2006 | Camenzind et al. | 508/452 |
| 2006/0128574 | A1 * | 6/2006 | Dong et al. | 508/557 |

FOREIGN PATENT DOCUMENTS

| | | |
|---|---|---|
| EP | 049 133 A1 | 4/1982 |
| EP | 572 866 A1 | 12/1993 |
| IN | 151316 | 3/1983 |
| JP | 53051206 | 5/1978 |
| JP | 59020392 | 2/1984 |
| PL | 149256 | 1/1990 |
| SU | 1155615 | 5/1985 |
| WO | 94/22988 | 10/1994 |

OTHER PUBLICATIONS

Formulators Guide to Albermarle Antioxidants, Albema Corp. Nov. 2005.*

"Effects of base oil type, oxidation test conditons, and phenolic antioxidant structure on the detection and magnitude of hindered phenol/diphenylamine synergism" Tribology and Lubrication Technology Article Date: Jan. 1, 1999. Gatto, VJ and Grina, MA.*

Product Data Sheet/Abstract XP-002476220 Naugalube® TMQ-polymerized 1,2-dihydro-2,2,4-trimethylquinoline (Apr. 2001).

* cited by examiner

*Primary Examiner* — Glenn A Caldarola
*Assistant Examiner* — Pamela Weiss
(74) *Attorney, Agent, or Firm* — Joseph Suhadolnik

(57) ABSTRACT

A lubricant composition is disclosed that comprises lubricating oil and a mixture of at least two antioxidants, the first antioxidant being a substituted diphenylamine and/or a heterocyclic amine and the second antioxidant being a substituted phenol. Also disclosed is a method of increasing the oxidation stability of a lubricating oil comprising adding thereto at least two antioxidants, the first antioxidant being a substituted diphenylamine and/or a heterocyclic amine and the second antioxidant being a substituted phenol.

11 Claims, No Drawings

STABILIZING COMPOSITIONS FOR LUBRICANTS

I claim the benefit under Title 35, United States Code, §119 to U.S. Provisional Application No. 60/776,934, filed Feb. 28, 2006 entitled STABILIZING COMPOSITION FOR LUBRICANTS.

BACKGROUND OF THE INVENTION

1. Field of the Invention

The present invention relates to improving the oxidation stability of lubricants, especially hydrocarbon based lubricating oils, by adding thereto a combination of at least two antioxidants.

2. Description of Related Art

Lubricants, such as those used in a variety of machinery, are susceptible to oxidative deterioration during storage, transportation, and usage, particularly when such lubricants are exposed to high temperatures and iron catalytic environments, which greatly promote their oxidation. This oxidation, if not controlled, contributes to the formation of corrosive acidic products, sludge, varnishes, resins, and other oil-insoluble products, and may lead to a loss of designated physical and tribological properties of the lubricants. It is therefore a common practice to include an antioxidant in lubricants to prevent, at least to some extent, oxidation, so as to extend their useful life. Lubricant compositions containing various diarylamines or phenolic compounds as antioxidants are widely known in the art.

U.S. Pat. No. 2,718,501 discloses a stabilizer system consisting of an aromatic amine with at least two aromatic rings, including para-phenylenediamine, and an organic aliphatic sulfur compound, which is said to be suitable for stabilizing mineral hydrocarbon lubricating oils, synthetic hydrocarbon oils, and polyalkylene glycol oils.

U.S. Pat. No. 5,091,099 discloses a phosphite-free lubricating oil composition which comprises a mineral oil or a synthetic oil or a mixture thereof, and a mixture containing at least one aromatic amine and at least one phenol. The lubricating oil compositions are said to be highly resistant to aging and are said to be effective in preventing black sludge formation.

U.S. Pat. No. 5,229,442 discloses stabilizing compositions for organic polymers, composed of mixtures of at least one liquid phenolic antioxidant and at least one aminic antioxidant, subjected to thermal treatment, that are characterized by their stabilizing capacity, which is considerably higher than that of either single components or of corresponding untreated mixtures. These stabilizing compositions can be used in all fields where the single components of the mixtures are generally used and, preferably, in the stabilization of organic polymers normally subject to deterioration due to oxidation processes.

U.S. Pat. No. 5,523,007 discloses a lubrication system comprising a diesel engine lubricating oil which is stabilized with an ester of a sterically hindered phenolic compound and the use of an ester of thio-ester compound for stabilizing diesel engine lubricating oils.

WO 94/22988 discloses a fuel composition said to improve the antiwear and viscosity controlling properties of an internal combustion engine lubricating oil during operation of the engine. Small amounts of the fuel composition combine with the engine lubricating oil during engine operation and this provides an antioxidant boost to the lubricating oil. Preferably the fuel contains at least 57 g/1000 liters of a substituted dicyclic aromatic amine which is free of benzylic hydrogen atom s such as a mono- and/or di-α-methyl styrene alkylated phenylenediamine and/or a hindered phenol such as a monostyrenated mono-isobutenated cresol or di $C_{16}$ alkyl phenol. A synergistic effect is said to be demonstrated by a mixture of the aromatic amine and hindered phenol.

JP 53,051,206 discloses N,N'-2-naphthyl-p-phenylenediamine as an antioxidant to improve the oxidation stabilities of ester or mineral oil based lubricating oils that also contain disulfides.

JP 59,020,392 discloses a lubricant composition comprising N,N'-di-sec-butyl-p-phenylenediamine for pressure forming of oil tanks. The lubricant composition also contains hindered phenolic antioxidant.

The foregoing disclosures are incorporated herein by reference in their entirety.

SUMMARY OF THE INVENTION

It has now been discovered that certain phenolic/aminic antioxidant blends offer unique synergy and improved performance, in terms of anti-oxidancy, when used within a lubricant base stock and/or lubricant formulation.

By "antioxidant blend" is meant a blend for treatment of industrial and automotive lubricants, which comprises a combination of aminic and phenolic antioxidant additives, and all plausible post-add and/or post-heat by-products thereof that may occur owing to action/reaction of said antioxidants via pre-blending and/or pre-heating of said antioxidants, and/or to action/reaction of said antioxidants within a lubricant base stock and/or lubricant formulation.

By "lubricant base stock" is meant a lubricant, such as mineral and synthetic base oils chosen from Group I, Group II, Group III, Group IV, as well as poly-alpha-olefins (PAO) and natural and synthetic esters, including polyol esters.

Base oils in Groups I-V are broadly specified in the American Petroleum Institute (API) Base Oil Interchangeability Guidelines. The five base oil groups are described in Table 1.

TABLE 1

| API Base Oil Category | Sulfur (%) | | Saturates (%) | Viscosity Index |
|---|---|---|---|---|
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Typically, base stocks are the above types of lubricants with only minimal additional additives, including, but not limited to antioxidant(s), rust inhibitor(s), metal passivator(s) and the like.

By "synthetic esters" is meant esters based on reaction products of polyols and carboxylic acids. Examples of typical polyols used to make synthetic esters include, but are not limited to, neopentyl glycol, trimethylolpropane, pentaerythritol, and dipentaerythritol, which are reacted with carboxylic acids, for example, valeric acid, isopentanoic acid, hexanoic acid, heptanoic acid, octanoic acid, and the like. Examples of commercial synthetic esters include, but are not limited to, polyol esters, trimellitates, adipates, oleates, and the like.

By "lubricant formulation" is meant a lubricant base stock, as described above, plus additional additives, including, but not limited to, antioxidant(s), rust inhibitor(s), metal passivator(s), ashless dispersant(s), anti-wear additives, extreme pressure (e.p.) additives detergents, and the like, and by-products thereof.

By "by-products thereof" is meant any by-product, reaction product, decomposition product, and the like that would be potentially, theoretically, and/or feasibly formed from the chemical and/or thermal/heat action/reaction between these components with and within the lubricant formulation.

More particularly, the present invention is directed to a lubricant composition comprising:

(A) at least one lubricating oil selected from the group consisting of natural and synthetic lubricating base oils;

(B) at least one first antioxidant selected from the group consisting of:

(1) diphenylamines represented by the formula

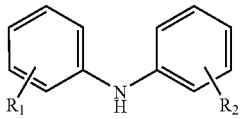

wherein $R_1$ and $R_2$ are independently selected from the group consisting of hydrogen, alkyl, styryl, and α-alkyl styryl, provided that at least one of $R_1$ and $R_2$ is not hydrogen; and (2) heterocyclic amines of the formula

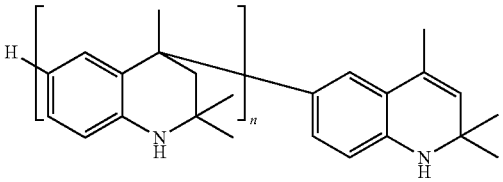

wherein n is an integer of from 0 to 50; and (C) at least one second antioxidant selected from the group consisting of phenols represented by the formula

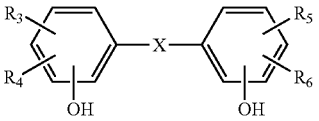

wherein $R_3$, $R_4$, $R_5$, and $R_6$ are independently selected from the group consisting of alkyl moieties and X is selected from the group consisting of sulfur, substituted or unsubstituted nitrogen, oxygen, alkylene, alkylene-S-alkylene, alkylene-O-alkylene, and —S—S—.

In another aspect, the present invention is directed to a method of increasing the oxidation stability of a lubricant comprising adding thereto (A) at least one first antioxidant selected from the group consisting of:

(1) diphenylamines represented by the formula

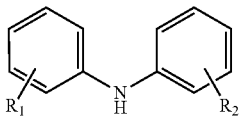

wherein $R_1$ and $R_2$ are independently selected from the group consisting of hydrogen, alkyl, styryl, and α-alkyl styryl, provided that at least one of $R_1$ and $R_2$ is not hydrogen; and (2) heterocyclic amines of the formula

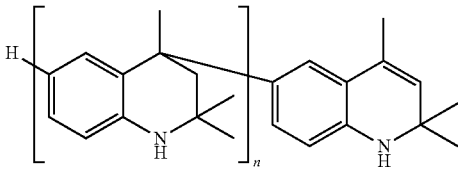

wherein n is an integer of from 0 to 50; and (B) at least one second antioxidant selected from the group consisting of phenols represented by the formula

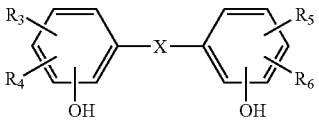

wherein $R_3$, $R_4$, $R_5$, and $R_6$ are independently selected from the group consisting of alkyl moieties and X is selected from the group consisting of sulfur, substituted or unsubstituted nitrogen, oxygen, alkylene, alkylene-S-alkylene, alkylene-O-alkylene, and —S—S—.

In another aspect, the present invention is directed to a method of increasing the oxidation stability of a lubricant comprising adding thereto (1) diphenylamines represented by the formula

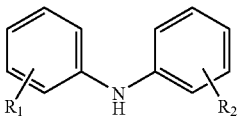

wherein $R_1$ and $R_2$ are independently selected from the group consisting of hydrogen, alkyl, styryl, and α-alkyl styryl, provided that at least one of $R_1$ and $R_2$ is not hydrogen; and (2) heterocyclic amines of the formula

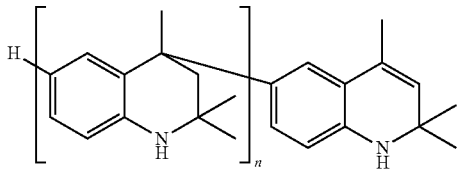

wherein n is an integer of from 0 to 50; and (B) at least one second antioxidant selected from the group consisting of phenols represented by the formula

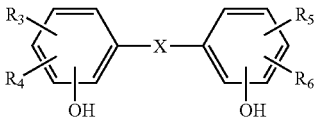

wherein $R_3$, $R_4$, $R_5$, and $R_6$ are independently selected from the group consisting of alkyl moieties and X is selected from the group consisting of sulfur, substituted or unsubstituted nitrogen, oxygen, alkylene, alkylene-S-alkylene, alkylene-O-alkylene, and —S—S—.

DESCRIPTION OF THE PREFERRED EMBODIMENTS

As stated above, the diphenylamines used as the first antioxidant in the practice of the present invention are represented by the formula

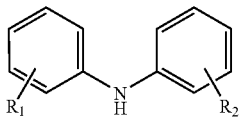

wherein $R_1$ and $R_2$ are independently selected from the group consisting of hydrogen, alkyl, styryl, and α-alkyl styryl, provided that at least one of $R_1$ and $R_2$ is not hydrogen.

Where $R_1$ and/or $R_2$ are alkyl, they are preferably independently selected alkyl groups of from 1 to 12 carbon atoms, which may be branched or straight-chain, e.g., methyl, ethyl, propyl, butyl, pentyl, hexyl, heptyl, octyl, nonyl, decyl, undecyl, dodecyl, isomers of the foregoing, e.g., t-butyl, 2-ethylhexyl, and the like, and mixtures of the foregoing.

Where $R_1$ and/or $R_2$ are α-alkyl styryl, the alkyl group is preferably lower alkyl, e.g., alkyl of from one to four carbon atoms, such as methyl, ethyl, propyl, isopropyl, n-butyl, sec-butyl, isobutyl, or t-butyl. Methyl or ethyl are more preferred, methyl most preferred.

Those skilled in the art will realize that the diphenylamine can comprise mixtures of alkylated/styrenated and non-alkylated/styrenated components and that these components could theoretically include non-alkylated and mono-, di- and tri-alkylated variants within the alkylated diphenylamine mixture.

Such alkylated and/or styrenated diphenylamine additives can be blended with or substituted by the heterocyclic amine antioxidant of the formula

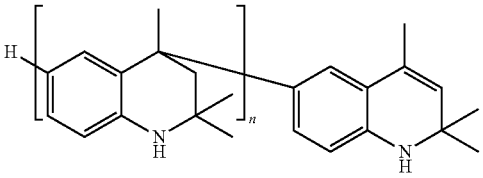

wherein the number of repeating units, n, is an integer of from 0 to 50. Commercially available examples of such compounds include Naugalube (NL) TMQ, Durad AX51, and Durad AX53.

A second antioxidant of the present invention is a phenol represented by the formula

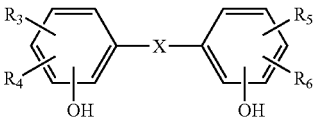

wherein $R_3$, $R_4$, $R_5$, and $R_6$ are independently selected from the group consisting of alkyl moieties and X is selected from the group consisting of sulfur (—S—), substituted or unsubstituted nitrogen, oxygen, alkylene, alkylene-S-alkylene, alkylene-O-alkylene, and —S—S—. By "alkylene" is meant a hydrocarbon of the formula $—C_nH_{2n}—$. Preferably n is an integer of from 1 to 10, e.g., methylene, ethylene, propylene, butylene, pentylene, hexylene, heptylene, octylene, nonylene, decylene, isomers of the foregoing, and mixtures thereof. X is preferably sulfur. The alkyl moieties attached to the phenolic rings are preferably of from one to ten carbon atoms, e.g., methyl, ethyl, propyl, butyl, pentyl, hexyl, heptyl, octyl, nonyl, decyl and isomers of the foregoing, such as t-butyl and 2-ethylhexyl.

More preferably, the first antioxidant of the present invention is an alkylated diphenylamine, where $R_1$ and $R_2$ are alkyl groups with the general formula of $C_nH_{2n+1}$, wherein n=4 to 9, suitably an octylated/butylated and/or nonylated diphenylamine, and the second antioxidant is a sulfur-containing alkylated phenol, wherein $R_3$ and $R_4$ are alkyl groups with the general formula $C_nH_{2n+1}$, wherein n=1 to 4. Commercially available examples of such alkylated diphenylamines include Durad AX57 (n=4 to 8), Durad AX59 (n=9), Naugalube 438, Naugalube 438L, and Naugalube 640.

Most preferably, the sulfur-containing alkylated phenol component of the above blends would be of the formula

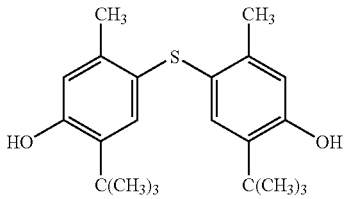

or the formula

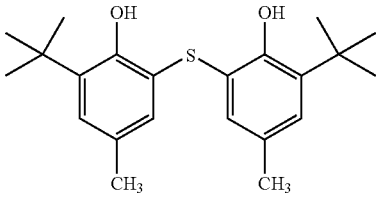

Commercially available examples of such alkylated phenols include Durad AX16, Lowinox TBM6, Lowinox TBP6, and Durad AX18.

Generally, a lubricant base stock and/or lubricant formulation can be treated directly with the above-described aminic and phenolic antioxidant components.

Preferably, the aminic and phenolic antioxidant additives are pre-blended to form a homogeneous liquid mixture, which in turn is added to the lubricant base stock and/or the lubricant formulation. The homogeneous liquid pre-blend mixture will preferably be fully miscible and stable to precipitation of solids upon storage and handling for a minimum duration of time, suitably up to 24 hours to allow for ease of handling.

Typically, the homogeneous liquid mixtures are pre-blended at elevated temperatures of from about 50 to about 100 C for from about 0.5 to about 6 hours, which will facilitate blending of viscous liquids and/or afford improved performance in terms of anti-oxidancy.

It is known in the art to pre-blend aminic antioxidants of the type described above with phenolic antioxidants of the structure

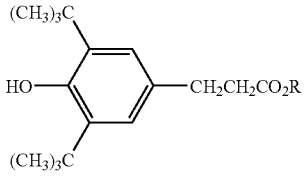

wherein R is $C_nH_{2n+1}$ and n 6 to 20, to afford enhanced stabilizing capacity for lubricant base stocks (see U.S. Pat. No. 5,229,442).

Preferably, the aminic and phenolic antioxidant additives can be blended with additional component(s) to form a homogeneous and fully miscible liquid blends that are stable for longer periods of time, preferably from 24 to 168 hours, more preferably for 168 to 336 hours, and most preferably for extended periods of time from 336 to 1000 hours or more.

Preferably, such additional component(s) can include, but are not limited to, Group I, Group II, Group III, or Group IV base stocks, triaryl and/or tri-alkyl phosphate esters, alkyl mono- and di-acid phosphates, alkyl and/or aryl phosphites, liquid phenolic antioxidants, aminic antioxidants, carboxylate esters, aromatic hydrocarbons, and liquid glycols (such as, for example, ethylene glycol).

More preferably, the aforementioned additional component(s) are selected from the group consisting of carboxylate esters, for example, trimellitate, adipate, phthalate, and oleate esters, and/or phosphate esters, such as trialkyl and/or triaryl phosphates and/or mixed alkyl/aryl phosphates.

Most preferably, the aforementioned additional component(s) are selected from the group consisting of tri-isobutylphosphate (TiBP), tri-butoxyethylphosphate (TBEP), trioctyl phosphate (TOP), and alkylated triphenyl phosphate esters, such as butylated and/or propylated triphenylphosphate, and mixtures of the foregoing.

Lubricant base stocks that can have their antioxidant properties increased by the antioxidant additive blend of the present invention include a lubricant, such as mineral and synthetic base oils chosen from Group I, Group II, Group III, Group IV, as well as PAO (poly-α-olefins), natural and synthetic esters, including polyol esters, more particularly, but not limited to, circulatory oils, engine oils, gear oils, greases, hydraulic fluids, turbine fluids, and metal working fluids.

Lubricant base stocks and/or lubricant formulations can have their anti-oxidancy properties vary over a wide range. This can be achieved by:

1. Proper choice of aminic and/or phenolic antioxidants that provide for best performance either individually or in combination, in terms of anti-oxidancy, within the lubricant base stock and/or lubricant formulation.
2. Changing the ratio of the antioxidant additives, such as the ratio of the phenolic antioxidant additive(s) to the aminic antioxidant additive(s), or
3. Keeping the aforementioned ratio constant while altering, either increasing or decreasing, the treat rate of the antioxidant additives in the base stock.

In other words, the components, either individually or in combination, can be tailored to provide the required performance characteristics, in terms of anti-oxidancy, in a particular base stock and/or lubricant formulation.

In the preparation of the lubricating oil compositions of the present invention, the first and second antioxidants can be blended in the compositions in a range of from about 0.01 to about 10 weight percent each, preferably from about 0.1 to about 5 weight percent. Optional components can also be blended in the lubricating oil compositions in a range of from about 0.01 to about 10 total weight percent, preferably from about 0.1 to about 5 weight percent. The content ratio of the first antioxidant to the second antioxidant employed in the lubricating oil compositions of the present invention can be in practically all proportions. But, preferably, the ratio will be in the range of 1:99 to 99:1 parts by weight, more preferably, 90:10 to 10:90 parts by weight.

As noted above, the antioxidant mixtures of the present invention can be used in combination with other additives typically found in lubricating oils, as well as other antioxidants. The additives typically found in lubricating oils are, for example, dispersants, detergents, antiwear agents, antioxidants, friction modifiers, seal swell agents, demulsifiers, VI (viscosity index) improvers, pour point depressants, antifoamants, corrosion inhibitors, and metal deactivators. Such additives are well known to those skilled in the art and there is no particular restriction on the type of these additives for this invention. U.S. Pat. No. 5,498,809, incorporated herein by reference, discloses useful lubricating oil composition additives.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants that can be used in combination with the antioxidant mixtures of the present invention include dimethyl quinolines, trimethyldihydroquinolines and oligomeric compositions derived therefrom, thiopropionates, metallic dithiocarbamates, oil soluble copper compounds, and the like. Examples of anti-wear additives that can be used in combination with the additives of the present invention include organoborates, organophosphites, organophosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; from Ciba Corporation: Irgalube® 62, Irgalube 211, Irgalube 232, Irgalube 349, Irgalube 353, Irgalube TPPT, Irgafos® OPH, among others; and from Chemtura Corporation: Weston® 600, Weston DLP, Weston TPP, among others.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of molybdenum additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others. Naugalube MolyFM is also exemplary of such additives and is commercially available from Chemtura Corporation.

Examples of VI improvers include olefin copolymers and dispersant olefin copolymers, and the like. An example of a pour point depressant is polymethacrylate, and the like. An example of an antifoamant is polysiloxane, and the like. Examples of rust inhibitors are polyoxyalkylene polyol, benzotriazole derivatives, and the like. Examples of metal deactivators include triazole, benzotriazole, 2-mercaptobenzothiazole, 2,5-dimercaptothiadiazole, tolyltriazole derivatives, N,N'-disalicylidene-1,2-diaminopropane, and the like. The following are exemplary of metal deactivators and are commercially available from Ciba Corporation: Irgamet® 30, Irgamet 39, and Irgamet 42.

Compositions, when they contain these additives, are typically blended into the base oil in amounts such that the additives therein are effective to provide their normal attendant functions. Representative effective amounts of such additives are illustrated in Table 2.

TABLE 2

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Antioxidant | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this action is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt.

The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, tallow oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{18}$ monocarboxylic acids and polyols and polyol ethers. Other esters useful as synthetic oils include those made from copolymers of $\alpha$-olefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly $\alpha$-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, steam and gas turbine lubricants, automatic transmission fluids, gear lubricants, compressor lubricants, metal-working lubricants, hydraulic fluids, and other lubricating oil and grease compositions. The additives can also be used to stabilize motor fuel compositions.

The advantages and the important features of the present invention will be demonstrated in the following examples.

EXAMPLES

Example 1

Table 3 lists the chemical properties of the antioxidants selected for testing. Depending on the test program and lubricant formulation, other additives such as antiwear agent, detergents, dispersant, pour point depressant, viscosity index improver, metal deactivator, corrosion inhibitor etc. were also used.

TABLE 3

Chemical names and descriptions to the antioxidants selected in this study

| Identification | Chemical name | Elemental |
|---|---|---|
| Durad AX18 | 2,2'-thiobis(4-methyl-6-tert-butyl-phenol) | 8.5 wt % S |
| Naugalube-438L | Nonylated diphenylamine | 3.5 wt % N |
| Naugalube-640 | Butylated, octylated diphenylamine | 4.2 wt % N |
| Naugalube-531 | 3,5-di-t-butyl-4-hydroxyhydrocinnamic acid, $C_7$-$C_9$ branched alkyl ester | — |

The base oils selected for this study included a solvent refined API Group I base stock, a hydrocracked API Groups II and III base stock obtained from different refineries in the U.S.

Blends were made by adding additives to the specific base oils and mechanically mixing at 65° C. for approximately 15 minutes under the protection of nitrogen. All blends were freshly prepared prior to the accelerated oxidation bench tests employing a pressurized differential scanning calorimetry (PDSC) and a Rotating Pressure Vessel Oxidation Test (RPVOT) apparatus.

The PDSC examines an oil's oxidative stability under thin-film oxidation conditions. In the isothermal mode where PDSC temperature is maintained at a predetermined value, a test oil's oxidation stability is ranked according to the oxidation induction time (OIT), corresponding to an exothermic release of heat caused by the onset of oxidation of the oil. Oil giving longer OIT is generally considered more resistant to oxidation. To expedite the PDSC testing process, each test oil was pre-treated with 50 ppm of oil soluble iron derived from ferric naphthenate. Each blend was tested in duplicate using the following instrumental conditions and the average OIT was determined. In order to obtain reproducible results, the optimum PDSC test temperatures were determined to be 185° C. for the Group I oil blends and 200° C. for all other blends utilizing the Groups II and III base stocks.

Isothermal temperature: 185° C. for Group I oil blends; 200° C. for Group II, III oil blends
Temperature ramp: 40° C./min
Pressures: 500 psi
$O_2$ flow: 100 ml/min
Sample size: ~1.5 mg
Pan: Aluminum, open
Catalyst: 50 ppm of ferric naphthenate (8% in mineral oil)

All RPVOT tests were performed in accordance with the ASTM D2272 standard test procedures and the results (OIT) from the average of duplicate runs were reported. An oil giving longer oxidation induction time is generally considered more resistant to oxidation.

Autosynergisin of lubricant antioxidants is a type of synergistic response resulting from two different functions in the same molecule. Like the Durad AX18, antioxidants with functional groups that provide radical scavenging and hydroperoxide decomposing functions may exhibit autosynergy under proper oxidation conditions, thus leading to superior performances. In the first round of the bench tests, Durad AX18 was compared to the Naugalube 531 under an equal level (1.0 wt %) in a series of fully formulated passenger car motor oils (PCMO) and industrial R&O turbine oils, each utilizing an API Group I, II, or III base oil. The engine oil blends were tested in the PDSC while the turbine oils were tested in the RPVOT with the test conditions described above. Tables 4 and 5 show the PDSC and the RPVOT test results, respectively, for all blends.

TABLE 4

PDSC results for Durad AX18 and Naugalube-531, tested at 1.0 wt % in PCMO formulations utilizing Group I, II or III base stock

| AO | Base Oil Type | PDSC T (° C.) | PDSC OIT, run 1 (min) | PDSC OIT, run 2 (min) | Mean PDSC, (min) |
|---|---|---|---|---|---|
| AX18 | Group I | 185 | 22.02 | 22.28 | 22.15 |
| NL-531 | Group I | 185 | 4.65 | 4.48 | 4.75 |
| AX18 | Group II | 200 | 9.05 | 10.42 | 9.74 |
| NL-531 | Group II | 200 | <1 | <1 | <1 |
| AX18 | Group III | 200 | 10.91 | 10.72 | 10.82 |
| NL-531 | Group III | 200 | <1 | <1 | <1 |

TABLE 5

RPVOT results for Durad AX18 and Naugalube-531, tested at 1.0 wt % in Industrial turbine oil formulations utilizing Group I, II or III base stock

| AO | Base Oil Type | RPVOT OIT (min) |
|---|---|---|
| AX18 | Group I | 251 |
| NL-531 | Group I | 264 |
| AX18 | Group II | 416 |
| NL-531 | Group II | 200 |
| AX18 | Group III | 488 |
| NL-531 | Group III | 300 |

The AX18 significantly outperformed the 531 in most formulations except for the Group I oil based turbine oil formulation. The loss of response in this oil was most likely due to the chemical nature of the base stock and the test method (the RPVOT) employed. Traces of nitrogen, sulfur, and oxygen-containing heterocycles, together with mercaptans (RSH), thioethers (R—S—R), and disulfides (R—S—S—R) are known to be an integral part of the complex composition of the Group I base oils. If the ratio of aromatics and sulfur is kept at an optimum level, the natural oil resistance to oxidation is maximized. It is therefore possible that due to the presence of these naturally occurred species the Naugalube-531 containing Group I turbine oil outperformed the analogous Group II oil in the RPVOT. It is also possible that because of these naturally balanced antioxidants the performance benefit derived from the further addition of sulfur was limited in the Group I oil. By introducing excessive sulfur, not only will the optimum sulfur/aromatic balance of the Group I oil be altered, the sulfur may also undergo hydrolysis in the RPVOT test environment to form sulfur acid species which are known to promote oxidation. Since the severely hydrocracked Groups II and III oils contain no appreciable sulfur, the sulfur derived from the AX18 had a strong and positive effect on the overall autosynergism of the antioxidant.

Having demonstrated the effect of base oil sulfur on the performance of AX18, the antioxidant was further examined in conjunction with the Naugalube-438L in the Groups II and III oils based lubricant formulations. A total of 1.0 wt % of varying combinations of the two antioxidants was blended along with other additives to form passenger car motor oils and industrial R&O turbine oils that were tested in the PDSC (@200° C.) and the RPVOT, respectively. The test results obtained are given in Tables 6 and 7.

As compared to the AX18 and Naugalube-531 data listed in Tables 4 and 5, the Naugalube-438L on its own outperformed the two phenolic antioxidants by generating significantly longer oxidation induction times in both PDSC and RPVOT. Upon mixing the Naugalube-438L with the AX18@3:1 ratio (w/w) and holding the total concentration of the antioxidants constantly at 1.0 wt %, a unique synergistic response was observed from the resulting mixtures. This response is first evident in the longer PDSC induction times (24.04; 24.99 minutes) of the mixtures over the corresponding 438L-only blends for the two groups of PCMO (Table 6). At this mixing ratio, the RPVOT performance of the turbine oils was also improved considerably with the oxidation induction time being driven to above 1300 minutes for the Group II oil and over 1700 minutes for the Group III oil (Table 7). The non S-containing Naugalube-531, which was included as reference in this round of tests, did not appear to be synergistic with the Naugalube-438L regardless of the formulation and test method.

Reproduction of the Naugalube-438L/Durad AX18 synergism by using another type of alkylated diphenylamine antioxidant, the Naugalube-640, was successful as well. As shown in Tables 8 and 9, considerable levels of synergism were observed for the Naugalube-640 and AX18 mixtures when the two antioxidants were blended at the 3:1 (w/w) ratio.

TABLE 6

PDSC results for Durad AX18 in varying combinations with Naugalube-438L, tested in PCMO formulations utilizing Group II or III base stock.

| AX18, wt % | NL-531, | NL-438L, wt % | Base Oil Type | PDSC OIT, run 1 (min) | PDSC OIT, run 2 (min) | Mean PDSC, |
|---|---|---|---|---|---|---|
| | | 1.0 | Group II | 21.66 | 22.05 | 21.86 |
| 0.5 | | 0.5 | Group II | 20.56 | 20.52 | 20.54 |
| 0.25 | | 0.75 | Group II | 23.34 | 24.74 | 24.04 |
| | 0.25 | 0.75 | Group II | 20.36 | 18.98 | 19.67 |
| | | 1.0 | Group III | 21.22 | 21.34 | 21.28 |
| 0.25 | | 0.75 | Group III | 24.83 | 25.14 | 24.99 |
| | 0.25 | 0.75 | Group III | 20.45 | 21.47 | 20.96 |

TABLE 7

RPVOT results for Durad AX18 in varying combinations with Naugalube-438L, tested in turbine oil formulations utilizing Group II or III base stock.

| AX18, wt % | NL-531, wt % | NL-438L, wt % | Base Oil Type | RPVOT OIT, min |
|---|---|---|---|---|
| | | 1.0 | Group II | 1270 |
| 0.5 | | 0.5 | Group II | 1162 |
| 0.25 | | 0.75 | Group II | 1344 |
| | 0.25 | 0.75 | Group II | 1117 |
| | | 1.0 | Group III | 1352 |
| 0.5 | | 0.5 | Group III | 1253 |
| 0.25 | | 0.75 | Group III | 1723 |
| | 0.25 | 0.75 | Group III | 1388 |

TABLE 8

PDSC results for Durad AX18 in varying combinations with Naugalube-640, tested in PCMO formulations utilizing Group II or III base stock.

| AX18, wt % | NL-531, wt % | NL-640, wt % | Base Oil Type | PDSC OIT, run 1 (min) | PDSC OIT, run 2 (min) | Mean PDSC, (min) |
|---|---|---|---|---|---|---|
| | | 1.0 | Group II | 21.54 | 22.67 | 22.11 |
| 0.5 | | 0.5 | Group II | 21.98 | 21.47 | 21.73 |
| 0.25 | | 0.75 | Group II | 25.26 | 25.62 | 25.44 |
| | 0.25 | 0.75 | Group II | 20.92 | 21.81 | 21.37 |
| | | 1.0 | Group III | 22.64 | 23.7 | 23.17 |
| 0.25 | | 0.75 | Group III | 25.77 | 25.33 | 25.55 |
| | 0.25 | 0.75 | Group III | 21.33 | 21.21 | 21.27 |

TABLE 9

RPVOT results for Durad AX18 in varying combinations with Naugalube-640, tested in turbine oil formulations utilizing Group II or III base stock

| AX18, wt % | NL-531, wt % | NL-640, wt % | Base Oil Type | RPVOT OIT, min |
|---|---|---|---|---|
| | | 1.0 | Group II | 1744 |
| 0.5 | | 0.5 | Group II | 1650 |
| 0.25 | | 0.75 | Group II | 1863 |
| | 0.25 | 0.75 | Group II | 1554 |
| | | 1.0 | Group III | 1779 |
| 0.5 | | 0.5 | Group III | 1353 |
| 0.25 | | 0.75 | Group III | 1860 |
| | 0.25 | 0.75 | Group III | 1665 |

The synergistic effects obtained from the AX18/ADPA mixtures can probably be attributed to a combined response from the autosynergism of the AX18 itself and the interaction of its active hydroxyl group with the Naugalube-438L through the homosynergistic mechanism that reinforce each other. It is this kind of mixed synergism that provided the AX18/ADPA systems additional stabilization power in both PDSC and RPVOT. The detection and magnitude of this type of synergy appear to be dependent on the type of base oil, more specifically the sulfur and aromatic contents of the oil as explained earlier, and also the mixing ratio of the two antioxidants involved. The importance of keeping the ratio optimum is exemplified by the inferior performances of the 1:1 (w/w) ratio of the AX18 and an ADPA in both PCMO and the turbine oils (Tables 4 through 7).

Example 2

Table 10 shows the relative oxidation stability results obtained by adding certain aminic and phenolic antioxidant blends to Group I and Group III base stocks.

TABLE 10

Relative Oxidation Stability Results in Group I and Group II Base Stocks (Minutes)

| Antioxidants | | Base Stock | |
|---|---|---|---|
| Aminic | Phenolic | Group I | Group II |
| — | — | 25 | 25 |
| — | Durad AX15 | 107 | 278 |
| — | Durad AX16 | 137 | 623 |
| — | Durad AX32 | 120 | 270 |

TABLE 10-continued

Relative Oxidation Stability Results in Group I and Group II Base Stocks (Minutes)

| Antioxidants | | Base Stock | |
|---|---|---|---|
| Aminic | Phenolic | Group I | Group II |
| Durad AX55 | — | 300 | 741 |
| Durad AX57 | — | 320 | 1140 |

Durad AX15 is 2,2'-thiodiethylene bis [3-(3,5-di-b-butyl-4-hydroxyphenyl) propionate.

Durad AX16 is 4,4'-thio bis(2-t-butyl-5-methyl phenol).

Durad AX32 is tetrakismethylene (3,5-di-t-butyl-4-hydroxyhydrocinnamate) methane.

Durad AX55 is octylated/styrenated diphenylamine

Durad AX57 is butylated/octylated diphenylamine

The five antioxidants are present at a 0.5% treat rate.

The relative oxidation stability of the various lubricant base stocks is determined by the rotating pressure vessel oxidation test (RPVOT), ASTM test method number D 2272. The oxidation stability is assessed as the lifetime, which is recorded in minutes.

Oxidation stability of these types of formulations can also be determined by differential thermal analysis (DTA), a variation of differential scanning calorimetry (DSC), ASTM test method number D 5483. The oxidation stability is assessed as the lifetime, which is recorded in minutes.

Table 11 shows examples of the relative oxidation stability results obtained by adding certain aminic and phenolic antioxidant blends to Group I and Group III base stocks.

TABLE 11

| RPVOT Lifetime for Antioxidant Blends (Minutes) | | | | | | |
|---|---|---|---|---|---|---|
| Antioxidant | | | Base Stock | | | |
| | | | Group I | | Group III | |
| Example | Aminic | Phenolic | Expected | Actual | Expected | Actual |
| | — | — | — | 25 | — | 25 |
| 1 | Durad AX55 | Durad AX15 | 261 | — | 649 | 355 |
| 2 | Durad AX55 | Durad AX32 | 264 | 271 | 647 | 865 |
| 3 | Durad AX57 | Durad AX15 | 277 | 255 | 968 | 385 |
| 4 | Durad AX57 | Durad AX16 | 283 | 300 | 1037 | 2580 |
| 5 | Durad AX57 | Durad AX32 | 280 | 328 | 966 | 730 |

The five antioxidant blends shown in Table 11 are present at a 0.5% total treat rate and an aminic/phenolic antioxidant ratio of 4:1 (wt/wt).

Both expected results, in terms of calculated "expected" results of the individual components based on Table 10 results, as well as actual results are shown.

The results in Table 11 above illustrate that a synergistic effect, in terms of anti-oxidancy, was seen with Blend 2 (Durad AX55+Durad AX32) when added to a Group III lubricant base stock, 865 minutes actual versus 647 minutes expected, 35% higher than expected.

Unexpectedly, a notable synergistic effect, in terms of anti-oxidancy, was seen with Blend 4 (Durad AX57+Durad AX16) when added to a Group III base stock, 2580 minutes actual versus 1037 minutes expected, 150% higher than expected.

The only other formulation where a synergistic effect could be noted was seen with Blend 5 (Durad AX57+Durad AX32) when added to a Group I lubricant base stock, 328 minutes actual versus 280 minutes expected, 17% higher than expected.

In all other blend examples shown in Table 11, the anti-oxidancy performance in Group I and/or Group III base stock ranged from 60% less than expected (Blend 3 in Group III base stock) to 6% greater than expected (Blend 4 in Group I base stock).

Example 3

Table 12 shows the relative oxidation stability results obtained by adding certain aminic and phenolic anti-oxidant blends to industrial turbine oils utilizing a Group II or a Group III base stock. With the type of antioxidant varied in the final formulations, all other additives, including a metal deactivator, a corrosion inhibitor, and a defoamer in the turbine oils remained the same and were kept at a constant level.

TABLE 12

| Relative Oxidation Stability Results (Minutes) for Turbine Oils Utilizing Group II and Group III Base Stocks | | | |
|---|---|---|---|
| Anti-Oxidants | | Base Stock Employed | |
| Aminic | Phenolic | Group II | Group III |
| — | — | | |
| — | Durad AX18 | 416 | 488 |
| — | Naugalube 531 | 200 | 300 |
| Naugalube 438L | — | 1270 | 1352 |
| Naugalube 640 | — | 1744 | 1779 |

Durad AX18 is 2,2-thiobis(6-t-butyl-4-methylphenol)
Naugalube 531 is 3,5-di-t-butyl-4-hydroxyhydrocinnamic acid, $C_7$-$C_9$ branched alkyl ester
Naugalube 438L is nonylated diphenylamine
Naugalube 640 is butylated-, octylated diphenylamine The four antioxidants are present at a 1.0 wt % treat rate. The relative oxidation stability of the various lubricant base stocks is determined by RPVOT, ASTM test method number D 2272. The oxidation stability is assessed as the lifetime, which is recorded in minutes.

Table 13 shows examples of the relative oxidation stability results obtained by adding certain aminic and phenolic anti-oxidant blends to industrial turbine oils utilizing Group II and Group III base stocks.

TABLE 13

| RPVOT Lifetime for Anti-Oxidant Blends (Minutes) | | | | | | |
|---|---|---|---|---|---|---|
| | | | Base Stock Employed | | | |
| | Anti-Oxidant | | Group II | | Group III | |
| Blend ID | Aminic | Phenolic | Expected | Actual | Expected | Actual |
| 6 | Naugalube 438L | Naugalube 531 | 1003 | 1117 | 1089 | 1338 |
| 7 | Naugalube 640 | Naugalube 531 | 1358 | 1554 | 1409 | 1665 |
| 8 | Naugalube 438L | Durad AX18 | 1057 | 1334 | 1136 | 1723 |
| 9 | Naugalube 640 | Durad AX18 | 1412 | 1863 | 1456 | 1860 |

The four anti-oxidant blends shown in Table 13 are present at a 1.0 wt % total treat rate and an aminic/phenolic anti-oxidant ratio of 3:1 (wt/wt). Both expected results, in terms of calculated "expected" results of the individual components, based on Table 5 results, as well as actual results are shown.

The results in Table 13 above illustrate that a synergistic effect, in terms of anti-oxidancy, was seen with blend 6 (Naugalube 438L+Naugalube 531) utilizing a Group II or Group III base stock. The actual minutes were 1117 versus the expected 1003 minutes for the Group II oil, being 11% higher. While for the Group III oil, 1338 minutes actual versus 1089 minutes expected, being 23% higher.

Similar levels of synergistic effect, in terms of anti-oxidancy, were seen with blend 7 (Naugalube 640+Naugalube 531) utilizing a Group II or Group III base stock. The actual minutes were 1554 versus the expected 1358 minutes for the Group II oil, being 14% higher. While for the Group III oil, 1665 minutes actual versus 1409 minutes expected, being 18% higher.

Unexpectedly a notable synergistic effect, in terms of anti-oxidancy, was seen with blend 8 (Naugalube 438L+Durad AX18) utilizing a Group II or Group III base stock. The actual minutes were 1334 versus the expected 1057 minutes for the Group II oil, being 26% higher. While for the Group III oil, 1723 minutes actual versus 1136 minutes expected, being 52% higher.

Similar levels of synergistic effect, in terms of anti-oxidancy, were seen with blend 9 (Naugalube 640+Durad AX18) utilizing a Group II or Group III base stock. The actual minutes were 1863 versus the expected 1412 minutes for the Group II oil, being 32% higher. While for the Group III oil, 1860 minutes actual versus 1456 minutes expected, being 28% higher.

In view of the many changes and modifications that can be made without departing from principles underlying the present invention, reference should be made to the appended claims for an understanding of the scope of the protection to be afforded the invention.

What is claimed is:

1. A lubricant composition comprising:

(A) at least one lubricating oil selected from the group consisting of natural and synthetic lubricating base oils;

(B) 0.1 to 5.0 weight percent based on the weight of the composition of at least one diphenylamine of the formula:

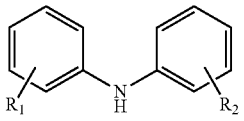

wherein $R_1$ and $R_2$ are independently selected from the group consisting of hydrogen, alkyl of 1 to 12 carbon atoms, styryl, and α-alkyl styryl, provided that at least one of $R_1$ and $R_2$ is not hydrogen; and (C) 2,2'-thiobis(4-methyl-6-tert-butyl-phenol) wherein the weight ratio of the diphenylamine to 2,2'-thiobis(4-methyl-6-tert-butyl-phenol) is greater than 3:1.

2. The composition of claim 1 which also comprises an additional component selected from the group consisting of triaryl phosphate esters, tri-alkyl phosphate esters, alkyl mono-acide phosphates, alkyl di-Acid phosphates, alkyl phosphites, aryl phosphites, liquid phenolic antioxidants, aminic antioxidants, carboxylate esters, aromatic hydrocarbons, and liquid glycols.

3. A method of increasing the oxidation stability of a lubricant comprising adding thereto (A) 0.1 to 5.0 weight percent based on the weight of the composition of at least one diphenylamine of the formula:

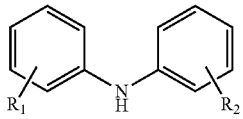

wherein $R_1$ and $R_2$ are independently selected from the group consisting of hydrogen, alkyl of 1 to 12 carbon atoms, styryl, and α-alkyl styryl, provided that at least one of $R_1$ and $R_2$ is not hydrogen; and (B) 2,2'-thiobis(4-methyl-6-tert-butyl-phenol)

wherein the weight ratio of the diphenylamine to 2,2'-thiobis(4-methyl-6-tert-butyl-phenol) is greater than 3:1 and the lubricant is selected from the group consisting of natural and synthetic lubricating base oils.

4. The composition of claim 1 wherein the weight ratio of the diphenylamine to 2,2'-thiobis(4-methyl-6-tert-butyl-phenol) ranges from about 3:1 to about 4:1.

5. The method of claim 3 wherein the weight ratio of the diphenylamine to 2,2-thiobis(4-methyl-6-tert-butyl-phenol) ranges from about 3:1 to about 4:1.

6. The composition of claim 1 wherein $R_1$ and $R_2$ are independently selected from the group consisting of hydrogen methyl, ethyl and isomers of propyl, butyl, pentyl, hexyl, heptyl, octyl, nonyl and decyl.

7. The composition of claim 1 wherein the diphenylamine is selected from the group consisting of nonylated diphenylamine; butylated, octylated diphenylamine; and octylated, styrenated diphenylamine.

8. The composition of claim 1 wherein the lubricating oil is selected from the group consisting of Group I, Group II and Group III API Base Oil Category base stocks.

9. The method of claim 3 wherein $R_1$ and $R_2$ are independently selected from the group consisting of hydrogen methyl, ethyl and isomers of propyl, butyl, pentyl, hexyl, heptyl, octyl, nonyl and decyl.

10. The method of claim 3 wherein the diphenylamine is selected from the group consisting of nonylated diphenylamine; butylated, octylated diphenylamine; and octylated, styrenated diphenylamine.

11. The method of claim 3 wherein the lubricant is selected from the group consisting of Group I, Group II and Group III API Base Oil Category base stocks.

* * * * *